US009546073B2

(12) United States Patent
Roberts et al.

(10) Patent No.: US 9,546,073 B2
(45) Date of Patent: Jan. 17, 2017

(54) ROPE SWAY MITIGATION THROUGH CONTROL OF ACCESS TO ELEVATORS

(71) Applicant: Otis Elevator Company, Farmington, CT (US)

(72) Inventors: Randall Keith Roberts, Hebron, CT (US); George Scott Copeland, Wethersfield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/024,386

(22) PCT Filed: Sep. 24, 2013

(86) PCT No.: PCT/US2013/061382

§ 371 (c)(1),
(2) Date: Mar. 24, 2016

(87) PCT Pub. No.: WO2015/047221

PCT Pub. Date: Apr. 2, 2015

(65) Prior Publication Data

US 2016/0244298 A1 Aug. 25, 2016

(51) Int. Cl.

| | |
|---|---|
| ***B66B 5/02*** | (2006.01) |
| ***B66B 7/06*** | (2006.01) |
| ***B66B 1/24*** | (2006.01) |
| ***B66B 1/34*** | (2006.01) |

(Continued)

(52) U.S. Cl.
CPC ..... *B66B 5/022* (2013.01); *B66B 1/24* (2013.01); *B66B 1/34* (2013.01); *B66B 5/0031* (2013.01); *B66B 7/06* (2013.01); *B66B 9/00* (2013.01); *B66B 2201/306* (2013.01)

(58) Field of Classification Search
CPC ..... B66B 5/022; B66B 5/06
See application file for complete search history.

(56) References Cited

U.S. PATENT DOCUMENTS 4,056,169 A * 11/1977 Showalter ..... B66B 5/022 187/278
4,193,478 A 3/1980 Keller et al.
4,460,065 A 7/1984 Saxer
(Continued)

FOREIGN PATENT DOCUMENTS

EP 2287101 B1 5/2012
JP H1067474 A 3/1998
(Continued)

OTHER PUBLICATIONS

International Search Report for application PCT/US2013/061382, Jun. 13, 2014, 5 pages.
(Continued)

*Primary Examiner* — Robert W Horn
(74) *Attorney, Agent, or Firm* — Cantor Colburn LLP

(57) ABSTRACT

Embodiments are directed to detecting motion of a building housing a multi-deck elevator system, determining, by a processing device, that the detected motion of the building is greater than a threshold, and controlling access to at least one deck of the elevator system based on determining that the detected motion of the building is greater than the threshold such that the at least one deck still is enabled to traverse a hoist-way of the elevator system.

17 Claims, 2 Drawing Sheets

(51) Int. Cl.

| | |
|---|---|
| ***B66B 5/00*** | (2006.01) |
| ***B66B 9/00*** | (2006.01) |

(56) References Cited

U.S. PATENT DOCUMENTS

| | | | | |
|---|---|---|---|---|
| 5,291,020 | A | 3/1994 | Lee | |
| 5,518,086 | A | 5/1996 | Tyni | |
| 5,663,538 | A | 9/1997 | Sakita | |
| 8,297,412 | B2 | 10/2012 | Roberts et al. | |
| 9,327,942 | B2 * | 5/2016 | Fukui | B66B 5/022 |
| 2010/0314202 | A1 * | 12/2010 | Roberts | B66B 1/2416 187/393 |
| 2013/0133983 | A1 | 5/2013 | Mangini et al. | |
| 2015/0166304 | A1 * | 6/2015 | Roberts | B66B 5/022 187/278 |
| 2016/0244298 | A1 * | 8/2016 | Roberts | B66B 5/022 |

FOREIGN PATENT DOCUMENTS

| | | | |
|---|---|---|---|
| JP | 2007153520 | A | 6/2007 |
| JP | 2012017192 | A | 1/2012 |

OTHER PUBLICATIONS

Kone, "Elevator terminology", http://mediacentre.kallaway.co.uk/pdf/elevator-terminology-final.docx.pdf accessed Mar. 23, 2016, 3 pages.

Thiago Teixeira, "A Survey of Human-Sensing: Methods for Detecting Presence, Count, Location, Track, and Identity", ENALAB at Yale University, ENALAB Technical Report Sep. 2010, vol. 1, No. 1, Sep. 2010.

Watanabe, Seiji, and Higashinaka, Tsunehiro, "Dynamic Simulation of Rope for High-speed Elevators", Mitsubishi Electric Advance, Mar. 2012, 3 pages.

Written Opinion for application PCT/US2013/061382, Jun. 13, 2014, 9 pages.

* cited by examiner

ROPE SWAY MITIGATION THROUGH CONTROL OF ACCESS TO ELEVATORS

BACKGROUND

In a given elevator system or environment, lateral motion may be induced in one or more ropes of the elevator (e.g., compensation ropes or hoist ropes). The lateral motion may at least partially result from a swaying or movement of a building in which the elevator system is located. For example, a large wind gust, an earthquake, etc., may cause a high-rise building to sway, which in turn may cause the elevator and its associated ropes to sway.

It may be desirable to limit or minimize these elevator rope sway conditions. For example, rope sway may cause a rope to impact a wall of a hoist-way which may cause a degradation of the rope. A rope that sways may create a loud sound when contacting an object, which can frighten elevator passengers. Rope vibrations can couple into an elevator car. In some instances, rope sway may cause an entanglement of the ropes that could lead to subsequent damage of the elevator and its associated components.

BRIEF SUMMARY

An embodiment is directed to a method comprising: detecting motion of a building housing a multi-deck elevator system, determining, by a processing device, that the detected motion of the building is greater than a threshold, and controlling access to at least one deck of the elevator system based on determining that the detected motion of the building is greater than the threshold such that the at least one deck still is enabled to traverse a hoist-way of the elevator system.

An embodiment is directed to an apparatus comprising: at least one processor, and memory having instructions stored thereon that, when executed by the at least one processor, cause the apparatus to: determine that a detected motion of a building housing a multi-deck elevator system is greater than a threshold, and control access to at least one deck of the elevator system based on determining that the detected motion of the building is greater than the threshold such that the at least one deck still is enabled to traverse a hoist-way of the elevator system.

An embodiment is directed to a multi-deck elevator system comprising: a controller comprising a processor configured to minimize rope sway by: receiving data indicative of a motion of a building housing the elevator system, determining that the detected motion of the building is greater than a threshold, and controlling access to at least one deck of the elevator system based on determining that the detected motion of the building is greater than the threshold such that the at least one deck still is enabled to traverse a hoist-way of the elevator system.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
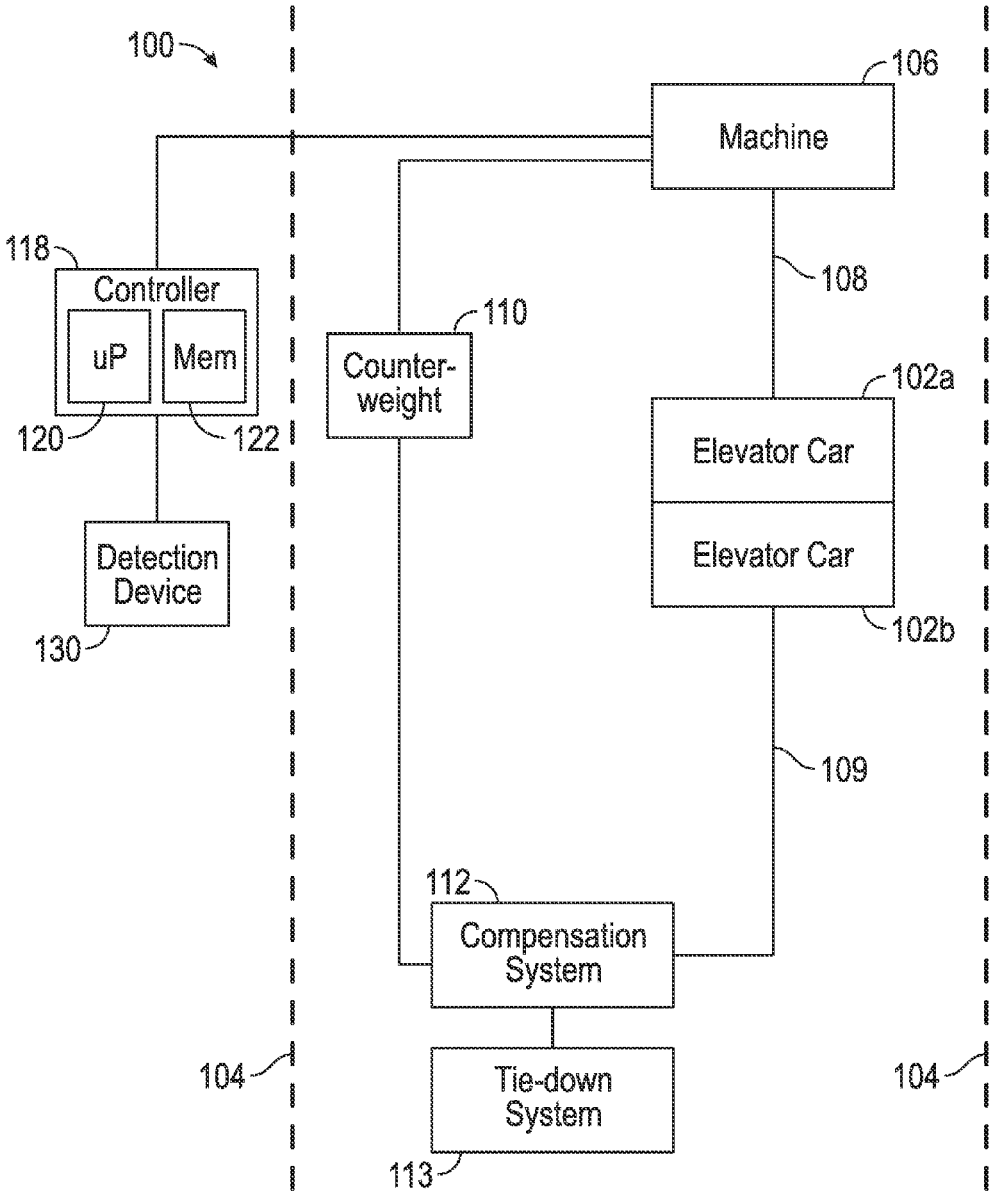
FIG. 1 illustrates an exemplary elevator system in accordance with one or more embodiments of the disclosure.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems and methods are described for detecting the occurrence or existence of a building sway condition. Elevator service may be controlled based on (e.g., in response to) the detection of whether, or to what degree or extent, a building housing an elevator is swaying.

In some embodiments, the way to control the amount of sway in an elevator rope is to adjust the tension of the ropes in order to shift its natural resonance away from that of the building sway. Embodiments of the disclosure use this principle in the form of a control system that senses building sway and reactively makes decisions about car loading and service to mitigate rope sway.

FIG. 1 illustrates a block diagram of an exemplary elevator system 100 in accordance with one or more embodiments. The organization and arrangement of the various components and devices shown and described below in connection with the elevator system 100 is illustrative. In some embodiments, the components or devices may be arranged in a manner or sequence that is different from what is shown in FIG. 1. In some embodiments, one or more of the devices or components may be optional. In some embodiments, one or more additional components or devices not shown may be included.

The system 100 may include one or more elevator cars 102 that may be used to convey, e.g., people or items up or down an elevator shaft or hoist-way 104. In the illustrative embodiment shown in FIG. 1, the system 100 includes two elevator cars, denoted as 102*a* and 102*b*. Such a configuration may be referred to as a double-deck elevator, which represents a specific instance of a more general multi-deck elevator configuration that may include any number of elevator cars 102.

One or more of the elevator cars 102 may be coupled to a machine 106, potentially via one or more hoist ropes or cables 108. The machine 106 may be associated with one or more motors, pulleys, gearboxes and/or sheaves as would be known to one of skill in the art to facilitate the movement or hoisting of the elevator cars 102 within the system 100.

In some embodiments, the machine 106 may be coupled to one or more counterweights 110. The counterweight 110 may serve to balance the weight associated with one or more of the elevator cars 102.

The counterweight 110 may be coupled to one or more of the elevator cars 102 via one or more compensation systems 112. The compensation system 112 may include one or more of: ropes or cables, pulleys, weights, and a tie-down sheave. The compensation ropes/cables may be used to control the elevator and may compensate for differing weight of hoist ropes/cables 108 between the elevator cars 102 and the top of the hoist-way 104. For example, if the elevator cars 102 are located towards the top of the hoist-way 104, then there may exist a short length of hoist ropes/cables 108 above the elevator cars 102 and a long length of compensating ropes/cables below the elevator cars 102. Similarly, if the elevator cars 102 are located towards the bottom of the hoist-way 104, then there may exist a long length of hoist ropes/cables 108 above the elevator cars 102 and a short length of compensating ropes/cables below the elevator cars 102.

The compensation system 112 may be coupled to a tie-down system 113. The tie-down system 113 is a device that ensures forces in the hoist ropes/cables 108 and compensation ropes/cables 109 are controlled during safety and/or brake operations in the system 100.

The system 100 may include a controller 118. In some embodiments, the controller 118 may include at least one processor 120, and memory 122 having instructions stored thereon that, when executed by the at least one processor 120, cause the controller 118 to perform one or more acts, such as those described herein. In some embodiments, the processor 120 may be at least partially implemented as a microprocessor (uP). In some embodiments, the memory 122 may be configured to store data. Such data may include data associated with one or more elevator cars 102, selected destinations for the elevator cars 102, etc.

The system 100 may include one or more detection devices 130. The detection device 130 may include one or more of a pendulum switch, an anemometer, and an accelerometer. The detection device 130 may be used to detect whether, or to what degree or extent, a building housing the system 100 is swaying or moving. Such sway/movement may be caused by wind or other factors.

The detection device 130 may provide data indicative of the sway/movement of the building to the controller 118. The controller 118 may control elevator service based on the data. For example, elevator service associated with (one or more of) the elevator cars 102 (e.g., elevator car 102*a*) may be shut-down or suspended in the event that the sway/movement of the building exceeds a threshold. A reduction in rope/cable (e.g., hoist rope/cable 108) sway may be realized based on the shut-down which limits the amount of tension in the hoist ropes/cables 108, while still potentially providing some level of elevator service.

Figure 2:
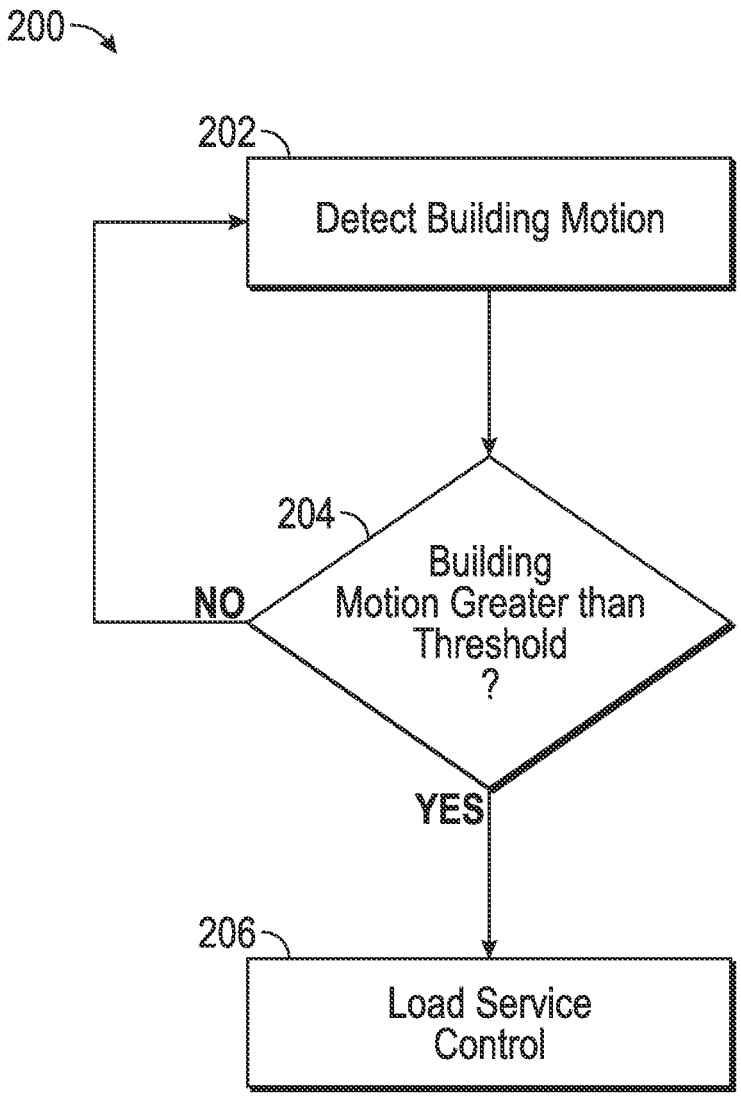
FIG. 2 illustrates a flow chart of an exemplary method in accordance with one or more embodiments of the disclosure.

Turning now to FIG. 2, a flow chart of an exemplary method 200 is shown. The method 200 may be used to control service provided by an elevator system (e.g., system 100) based on movement or sway of a building housing the elevator system. The method 200 may be executed by one or more devices or components, such as those described herein (e.g., controller 118).

In block 202, building motion or sway may be detected. For example, such detection may be based on data derived from, or obtained from, a detection device (e.g., detection device 130).

In block 204, a determination may be made whether the building motion is greater than one or more thresholds. If not (e.g., the "no" path is taken out of block 204), flow may proceed from block 204 to block 202 to continue to obtain data indicative of potential building motion. On the other hand, if the building motion is greater than a threshold (e.g., the "yes") path is taken out of block 204), flow may proceed from block 204 to block 206.

In block 206, the load and floor service control may control the deck service associated with one or more decks of a multi-deck elevator system based on the determination of block 204. For example, if the movement of the building exceeds a first threshold, deck service may be limited to a particular number of floors or landings in the building. If the movement of the building exceeds a second threshold, wherein the second threshold may be greater than the first threshold, service associated with one or more cars or decks may be shut-down or suspended. Other types of controls for deck service are possible.

The method 200 is illustrative. In some embodiments, one or more of the blocks or operations (or portions thereof) may be optional. In some embodiments, the operations may execute in an order or sequence different from what is shown. In some embodiments, one or more additional operations not shown may be included.

In some embodiments, deck or car service may be controlled as a function of load. For example, in some embodiments, a deck or car of a multi-deck elevator may still be enabled to traverse a hoist-way, but might not have any passengers or freight located therein. In some embodiments, a load in a deck or car might be restricted to be less than some value (but may be allowed to be greater than zero, corresponding to a no-load condition). For example, if a deck could otherwise support a nominal capacity of 2,000 pounds under normal/non-sway conditions, and if the detected sway conditions for the building exceed a threshold, the capacity for the deck may be limited to 1,000 pounds. The 1,000 pound limitation may be enforced by an attendant or other personnel restricting access to the elevator, an overload alarm, or a dispatching controller (e.g., controller 118 of FIG. 1) directing passengers to cars or decks so as to not exceed the 1,000 pound limitation. In some embodiments, a warning or message may be provided when the 1,000 pound limitation is exceeded and may request one or more passengers to disembark from the deck or car.

Additional techniques may be used to mitigate the likelihood or extent or rope or cable sway. For example, if a deck or car currently occupies a space within a hoist-way in which the rope/cable sway exceeds a threshold, the deck or car may be restricted to only making a number of stops at particular floors or landings. In some instances, the car or deck may be prohibited from stopping or parking at particular locations within the hoist-way (e.g., at particular floors or landings). In some instances, the velocity or acceleration of a car or deck may be modified (e.g., slowed) in order to allow energy associated with the sway to dissipate. In some instances, a passive strategy may be used. For example, weight associated with a compensation system (e.g., compensation system 112 of FIG. 1) and tie-down system (e.g., tie-down system 113 of FIG. 1) may be adjusted (e.g., added or subtracted) in an effort to reduce or minimize sway.

In some embodiments, one or more filtering techniques may be applied to provide greater accuracy with respect to the determination of building movement or sway. For example, averaging may be used to reduce the likelihood of a single measurement impacting service.

In some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory having instructions stored thereon that, when executed by the one or more processors, cause the apparatus or system to perform one or more methodological acts as described herein. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

detecting motion of a building housing a multi-deck elevator system;

determining, by a processing device, that the detected motion of the building is greater than a threshold; and controlling access to at least one deck of the elevator system based on determining that the detected motion of the building is greater than the threshold such that the at least one deck still is enabled to traverse a hoist-way of the elevator system.

2. The method of claim 1, wherein controlling access to the at least one deck comprises prohibiting access to the at least one deck.

3. The method of claim 1, wherein controlling access to the at least one deck comprises limiting the capacity of the deck to a value that is less than a nominal rating for the at least one deck.

4. The method of claim 3, wherein the capacity limit is enforced by an attendant or other personnel.

5. The method of claim 3, wherein the capacity limit is enforced by an overload alarm.

6. The method of claim 1, wherein controlling access to the at least one deck comprises limiting the at least one deck in terms of stops at particular landings.

7. The method of claim 1, wherein controlling access to the at least one deck comprises prohibiting the at least one deck from stopping at a particular location within the hoist-way.

8. An apparatus comprising:

at least one processor; and memory having instructions stored thereon that, when executed by the at least one processor, cause the apparatus to:

determine that a detected motion of a building housing a multi-deck elevator system is greater than a threshold, and control access to at least one deck of the elevator system based on determining that the detected motion of the building is greater than the threshold such that the at least one deck still is enabled to traverse a hoist-way of the elevator system.

9. The apparatus of claim 8, wherein the instructions, when executed by the at least one processor, cause the apparatus to:

prohibit passenger access and freight access to the at least one deck based on determining that the detected motion of the building is greater than the threshold.

10. The apparatus of claim 8, wherein the instructions, when executed by the at least one processor, cause the apparatus to:

limit the capacity of the deck to a value that is less than a nominal rating for the at least one deck based on determining that the detected motion of the building is greater than the threshold.

11. The apparatus of claim 8, wherein the instructions, when executed by the at least one processor, cause the apparatus to:

limit the at least one deck in terms of stops at particular landings based on determining that the detected motion of the building is greater than the threshold.

12. The apparatus of claim 8, wherein the instructions, when executed by the at least one processor, cause the apparatus to:

prohibit the at least one deck from stopping at a particular location within the hoist-way based on determining that the detected motion of the building is greater than the threshold.

13. A multi-deck elevator system comprising:

a controller comprising a processor configured to minimize rope sway by:

receiving data indicative of a motion of a building housing the elevator system, determining that the detected motion of the building is greater than a threshold, and controlling access to at least one deck of the elevator system based on determining that the detected motion of the building is greater than the threshold such that the at least one deck still is enabled to traverse a hoist-way of the elevator system.

14. The elevator system of claim 13, wherein the controller is configured to:

prohibit passenger access and freight access to the at least one deck based on determining that the detected motion of the building is greater than the threshold.

15. The elevator system of claim 13, wherein the controller is configured to:

limit the capacity of the deck to a value that is less than a nominal rating for the at least one deck based on determining that the detected motion of the building is greater than the threshold.

16. The elevator system of claim 13, further comprising:

a detection device configured to transmit the data to the controller.

17. The elevator system of claim 13, wherein the detection devices comprises at least one of a pendulum switch, an anemometer, and an accelerometer.

* * * * *